US007534098B2

(12) United States Patent
Stirling et al.

(10) Patent No.: US 7,534,098 B2
(45) Date of Patent: May 19, 2009

(54) SUCTION DISTRIBUTION AND DISCONNECTION SYSTEM FOR A SUBMERSIBLE PUMP

(75) Inventors: Thomas E. Stirling, Sugarloaf, PA (US); David V. Rondosh, Hazleton, PA (US)

(73) Assignee: Weir Minerals Australia, Ltd., Artarmon (AU)

( * ) Notice: Subject to any disclaimer, the term of this patent is extended or adjusted under 35 U.S.C. 154(b) by 560 days.

(21) Appl. No.: 10/811,544

(22) Filed: Mar. 29, 2004

(65) Prior Publication Data

US 2005/0214143 A1 Sep. 29, 2005

(51) Int. Cl.
*F04B 35/04* (2006.01)

(52) U.S. Cl. ..... 417/423.15; 417/423.3; 417/423.5; 417/360

(58) Field of Classification Search ..... 417/360, 417/361, 423.9, 423.5, 423.3, 423.15
See application file for complete search history.

(56) References Cited

U.S. PATENT DOCUMENTS 3,018,925 A * 1/1962 Englesson ..... 222/180
3,427,982 A * 2/1969 Englesson ..... 415/126
3,771,915 A * 11/1973 Back ..... 417/360
4,308,000 A * 12/1981 Oakes ..... 417/360
4,902,204 A * 2/1990 Hofstad ..... 417/360
5,030,346 A * 7/1991 McEwen ..... 210/258
5,529,462 A * 6/1996 Hawes ..... 417/360

* cited by examiner

*Primary Examiner*—Charles G Freay
*Assistant Examiner*—Peter J Bertheaud
(74) *Attorney, Agent, or Firm*—Morriss O'Bryant Compagni

(57) ABSTRACT

A solids entrainment and quick disconnect system for a vertical or submersible pump is disclosed in which a pump distribution plate having guide members is provided for positioning near the floor of a well or sump to facilitate the entrainment of solids into the pump inlet. The quick disconnect system comprises an angled discharge adaptor that allows the pump to be vertically lowered onto the pump distribution plate in a manner to not only assure registration and sealing of the pump inlet to the pump distribution plate, but to provide comprehensive mating and sealing of the pump discharge outlet to the discharge piping of the sump or pit.

12 Claims, 6 Drawing Sheets

SUCTION DISTRIBUTION AND DISCONNECTION SYSTEM FOR A SUBMERSIBLE PUMP

BACKGROUND OF THE INVENTION

1. Field of the Invention

This invention relates to vertical or submersible pumps and specifically relates to a suction distribution system for increasing solids entrainment and an attendant pump disconnection system.

2. Description of Related Art

Vertical or submersible pumps are used in a variety of industries for placement in a submerged tank, sump, wet well or pit for pumping fluid, such as wastewater, therefrom. In earlier times, any maintenance or replacement of submersible pumps would have to be conducted downhole by a worker lowered into the hole or tank. However, the development of disconnect and liftout systems has since enabled the pump to be brought out of the hole or tank for maintenance, repair or replacement.

Different disconnect and liftout systems have been developed for submersible pumps over the years. In general, prior disconnect and liftout systems have involved lowering the pump vertically into the hole using vertical guide rails. As the pump was lowered by use of the guide rails, mating vertical elements of flanges of a stationary discharge pipe and discharge outlet of the pump were thereby brought into sealing contact. However, a comprehensive sealing arrangement at the discharge outlet was not always achieved with such systems.

Today, existing quick disconnect systems for submersible pumps require a vertical lowering and rotation of the pump to bring the discharge outlet of the pump into mating and sealing relationship with a discharge elbow in the discharge piping. Rotation of the pump in present disconnect systems is possible because the pump inlet is typically lowered to a position at or near the bottom of the pit or sump for pumping of fluid from the pit. However, certain pumping limitations may result, especially in the pumping of solids-laden fluids where the use of a fluid or solids entrainment apparatus at the bottom of the hole or tank would prevent the use of a disconnect system of the conventional type where rotation of the pump is required.

Thus, it would be advantageous in the art to provide a means for improving solids entrainment for a submersible pump and to provide a quick disconnect system that is compatible with a solids entrainment system to not only improve pumping efficiencies, but to provide a comprehensive sealing arrangement between both the pump discharge outlet and the pump inlet.

BRIEF SUMMARY OF THE INVENTION

In accordance with the present invention, a solids entrainment system and a quick disconnect system for a vertical or submersible pump are provided for improving pumping efficiencies and for providing improved sealing at the discharge outlet and pump inlet of the pump. In accordance with the invention, improved solids entrainment is provided by use of a pump distribution plate that is positioned at or near the bottom of the sump pit, well or tank, and the disconnect system employs an angled discharge adaptor device for assuring a comprehensive sealing between the discharge outlet of the pump and the discharge piping in the sump pit, well or tank.

The pump distribution plate of the present invention generally comprises a linear plate that is sized for positioning near the bottom of a sump pit, well or tank. The pump distribution plate may preferably have an arrangement of guide members that extend from the bottom surface of the plate toward the floor of the sump pit, tank or well. The pump distribution plate has at least one opening formed through the plate which is sized to receive the inlet of a pump in fluid communication therewith. The guide members are arranged on the bottom surface of the pump distribution plate to define the area from which the pump can draw liquid, thereby creating increased velocities between the pump distribution plate and the floor of the pit, well or tank to facilitate entrainment of solids.

The pump distribution plate may be provided with a centering member for aiding in positioning of the pump inlet in connection with the pump distribution plate and for assuring a sealed mating of the pump inlet to the pump distribution plate. The pump distribution plate may also be configured for accommodating a plurality of pumps thereon. The pump distribution plate of the present invention can be used with removable pumps, as described particularly in this disclosure, but may also be employed with non-removable pumps as well (i.e., where the pump is essentially integrally connected to the pump distribution plate and the pump and pump distribution plate are lowered and lifted out in tandem).

The quick disconnect system of the present invention further comprises a discharge adaptor member which connects the discharge outlet of the pump to the discharge elbow of the discharge piping of the sump pit, tank or well. The discharge adaptor has an angled mating surface and sealing ring that assures a comprehensive mating and sealing between the pump discharge outlet and the discharge piping, thus enabling the vertical dissent of the pump onto the centering member of the pump distribution plate and eliminating the need to rotate the pump into position, which would not be feasible with the pump distribution plate of the present invention.

BRIEF DESCRIPTION OF THE SEVERAL VIEWS OF THE DRAWINGS

In the drawings, which illustrate what is currently considered to be the best mode for carrying out the present invention.

DETAILED DESCRIPTION OF THE INVENTION

Figure 1:
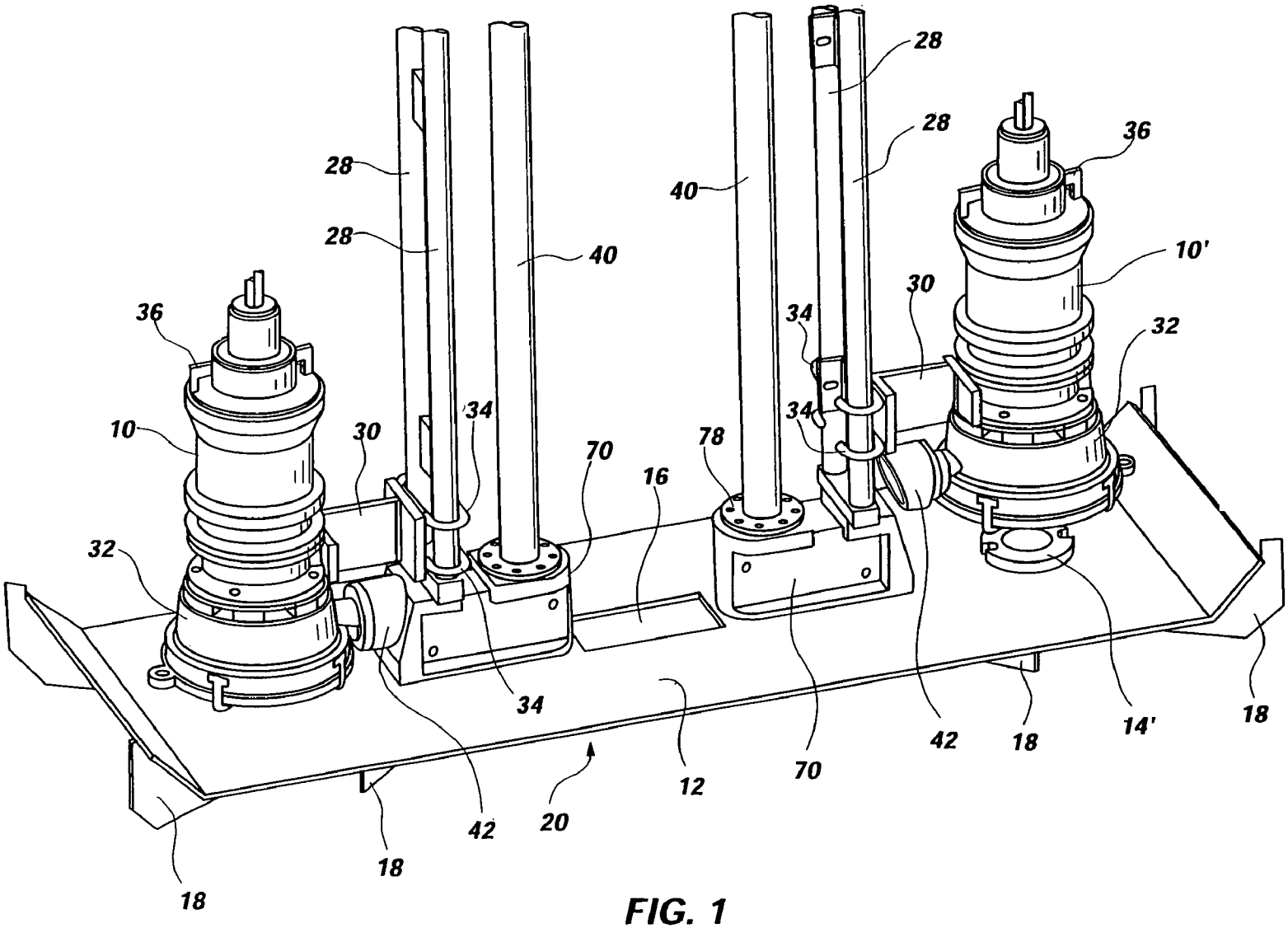
FIG. 1 is a perspective view of dual submersible pumps positioned with respect to an embodiment of the pump distribution plate of the present invention.

The principal elements of the present invention are illustrated in FIG. 1 which shows, by way of example only, a pumping system comprising two submersible pumps 10,10'. The present invention does not require two pumps, however, and may be employed with a single submersible or vertical pump. The submersible pumps 10,10' are each shown positioned, or positionable, on a pump distribution plate 12 which is provided to increase the area of effective solids entrainment around the inlet of the pump.

Figure 3:
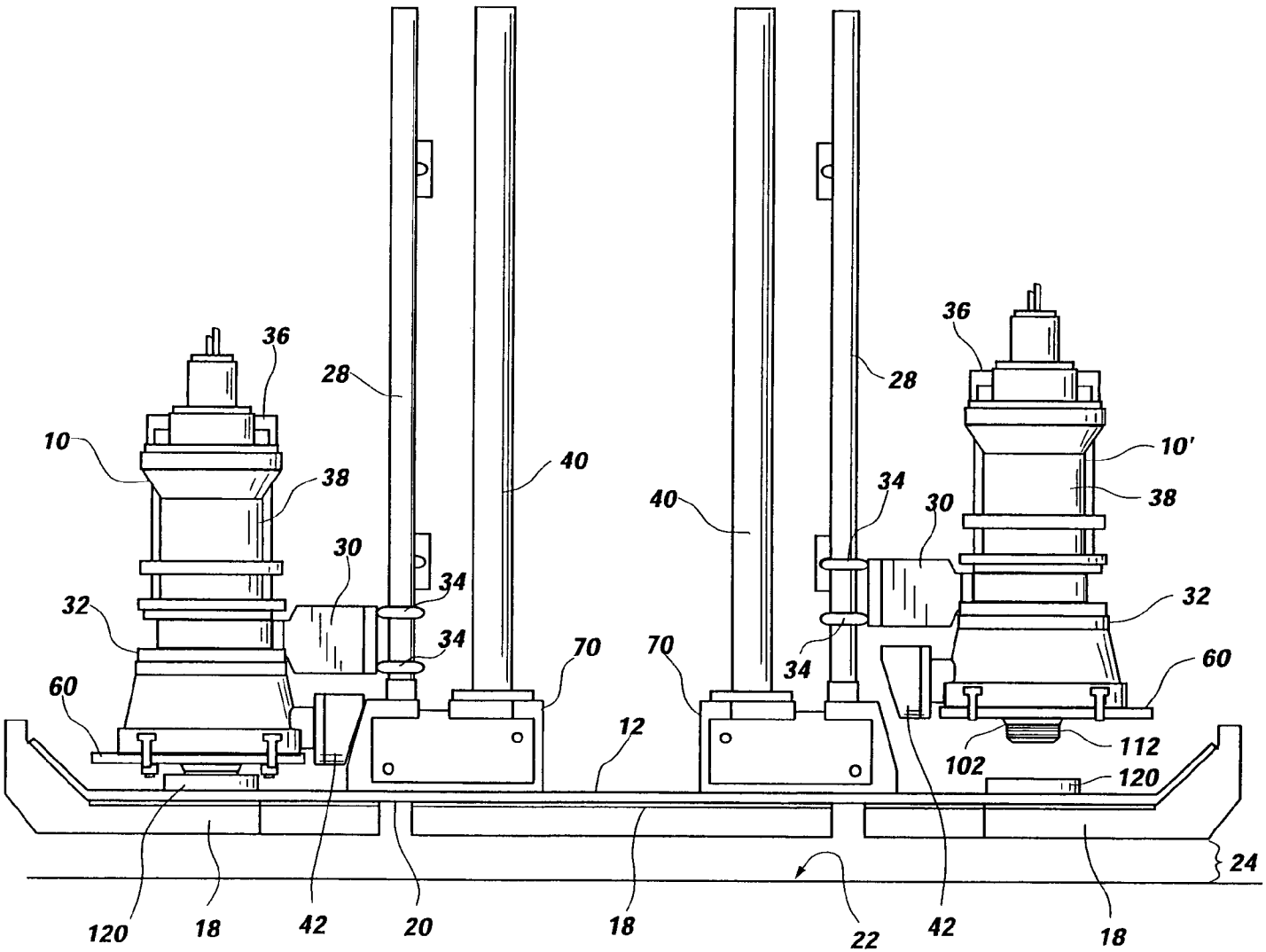
FIG. 3 is a view in elevation of the dual pump embodiment of the invention shown in FIG. 1 with one of the pumps disconnected from the discharge piping.

The pump distribution plate 12 is generally formed as a flattened or linear sheet of material and is sized to be receivable within a sump pit, well or tank (not shown). The pump distribution plate 12 is structured to be supported on the bottom surface or floor of the sump pit, well or tank (hereinafter generically referred to as a "well"). Alternatively, as shown in FIG. 3, the pump distribution plate 12 may be fixedly or adjustably suspended above the floor of the sump pit by attachment to a device (not shown) that traverses the pit or tank. Accordingly, the pump distribution plate 12 may be structured to be moveable in either a vertical of horizontal direction depending on the application and installation requirements.

The pump distribution plate 12 is structured with a pump opening 14' (only one being viewable in FIG. 1) which is sized to receive the inlet of the pump 10' as illustrated and described further hereinafter. The pump distribution plate 12 illustrated in FIG. 1 is formed with a central opening 16 which provides means for insertion on or connection to a support column in certain types of installations.

Figure 2:
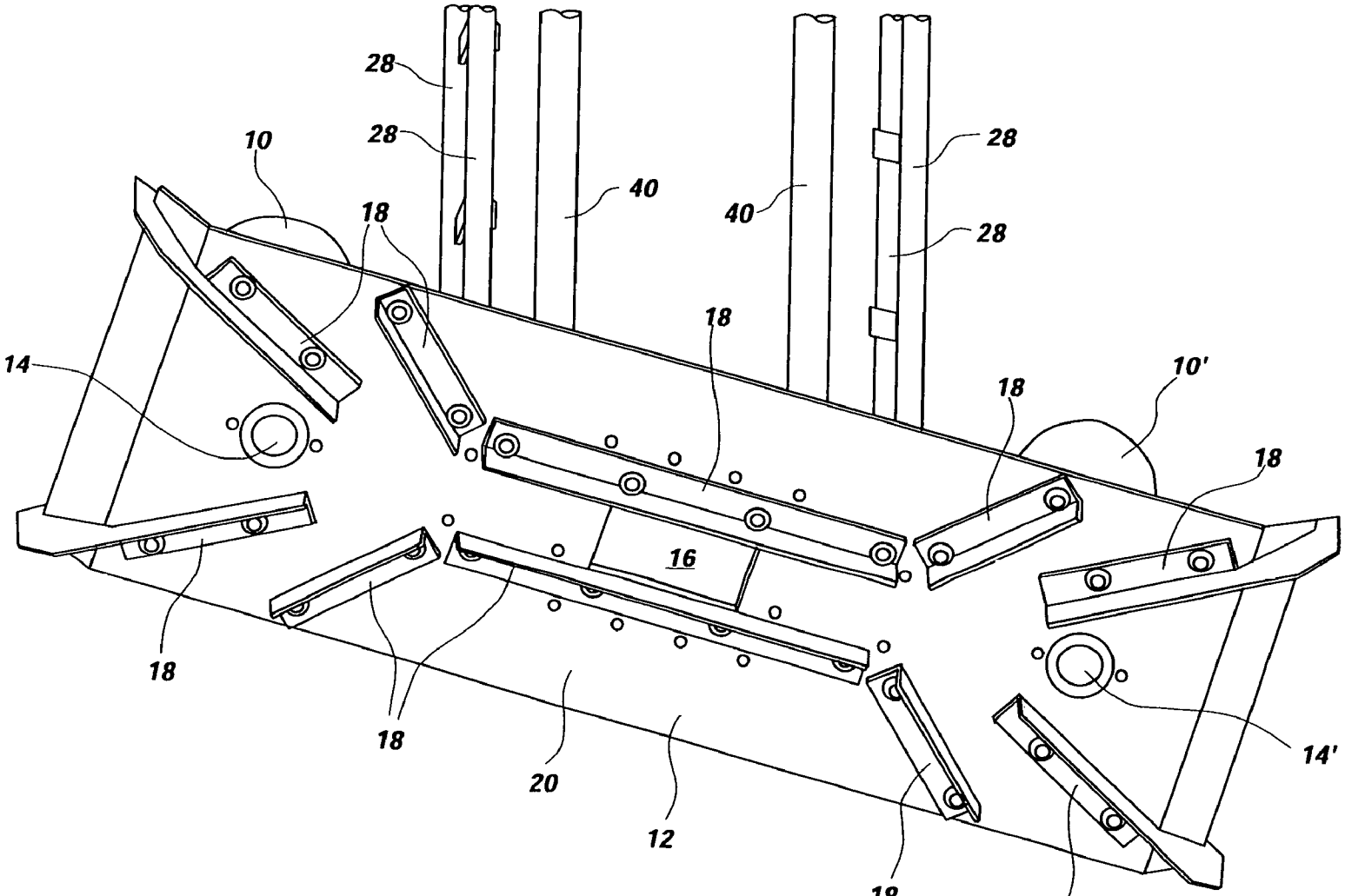
FIG. 2 is a perspective view of the bottom surface of the pump distribution plate shown in FIG. 1.

The pump distribution plate 12 is further structured with guide members 18, which are more clearly illustrated in FIGS. 2 and 3. The guide members 18 generally extend outwardly from the bottom surface 20 of the pump distribution plate 12 in a direction toward the floor or bottom of the well and may provide support for positioning the pump distribution plate 12 on the floor 22 of the well. As shown in FIG. 2, the guide members 18 are positioned relative to the pump openings 14, 14' and in an orientation to direct fluid, and more importantly solids, toward the pump openings 14, 14'.

The guide members 18 may be structured in any suitable manner, and may be positioned or oriented in any suitable manner, which facilitates direction and movement of the solids toward the pump suction of the submersible pump 10, 10'. The guide members 18 are advantageously positioned relative to the pump openings 14 and to the floor 22 of the well to create increased velocities between the pump distribution plate 12 and the floor 22 to facilitate entrainment of the solids by the pump 10.

In an alternative embodiment, the pump distribution plate 12 may lack the guide members 18 and may essentially comprise only a linear sheet of material having at least one pump opening 14 for receiving a pump inlet. In such an embodiment, the pump distribution plate 12 is lowered to a depth in the well such that the space 24 (FIG. 3) formed between the pump distribution plate 12 and the floor 22 of the well is no more than three times the diameter of the pump inlet. At that prescribed spacing, increased velocities are created between the pump distribution plate 12 and the floor 22 to facilitate entrainment of solids. Additionally, the pump distribution plate 12 controls the drawing of air into the pump suction when the pump is operating at low submergence (i.e., the height of fluid in the well above the pump inlet).

It can be seen that employing a pump distribution plate 12 of the present invention in a well precludes the use of the conventional means for quickly disconnecting the pump for lift out from the well, which involves rotating the pump to bring the pump discharge outlet into mating contact with the discharge piping of the well. Therefore, the present invention includes a disconnect system that enables a quick disconnection of a submersible pump from the pump distribution plate and discharge piping by vertical movement of the pump, rather than by the conventional rotation means.

Referring again to FIG. 1, the submersible pumps 10,10' in the pumping system of the present invention are lowered into and out of the well by employment of conventionally known guide rails 28. A guide rail bracket 30, secured to the pump casing 32 of the pump 10, has at least one arm 34 which slidingly engages the guide rails 28 to guide and direct the pump 10 in its vertical movement into and out of the well. The movement of the pump 10 is typically enabled by attachment of a hoisting line (not shown) to an eye 36 formed on the motor housing 38 of the pump 10. As the hoisting line raises and lowers the pump 10 into the well, the sliding guide arms 34 moving along the guide rails 28 help keep the pump 10 at an appropriate orientation and positioning relative to the pump distribution plate 12.

FIGS. 1 and 3 illustrate one of the pumps 10 as being fully connected to the discharge piping 40 of the well and the other pump 10' is shown disconnected from the discharge piping 40. What enables the pump 10, 10' to be disconnected and moved vertically within the well is the use of a discharge adaptor 42 that is configured to provide comprehensive mating and sealing of the pump discharge outlet to the discharge piping 42 of the well.

Figure 4:
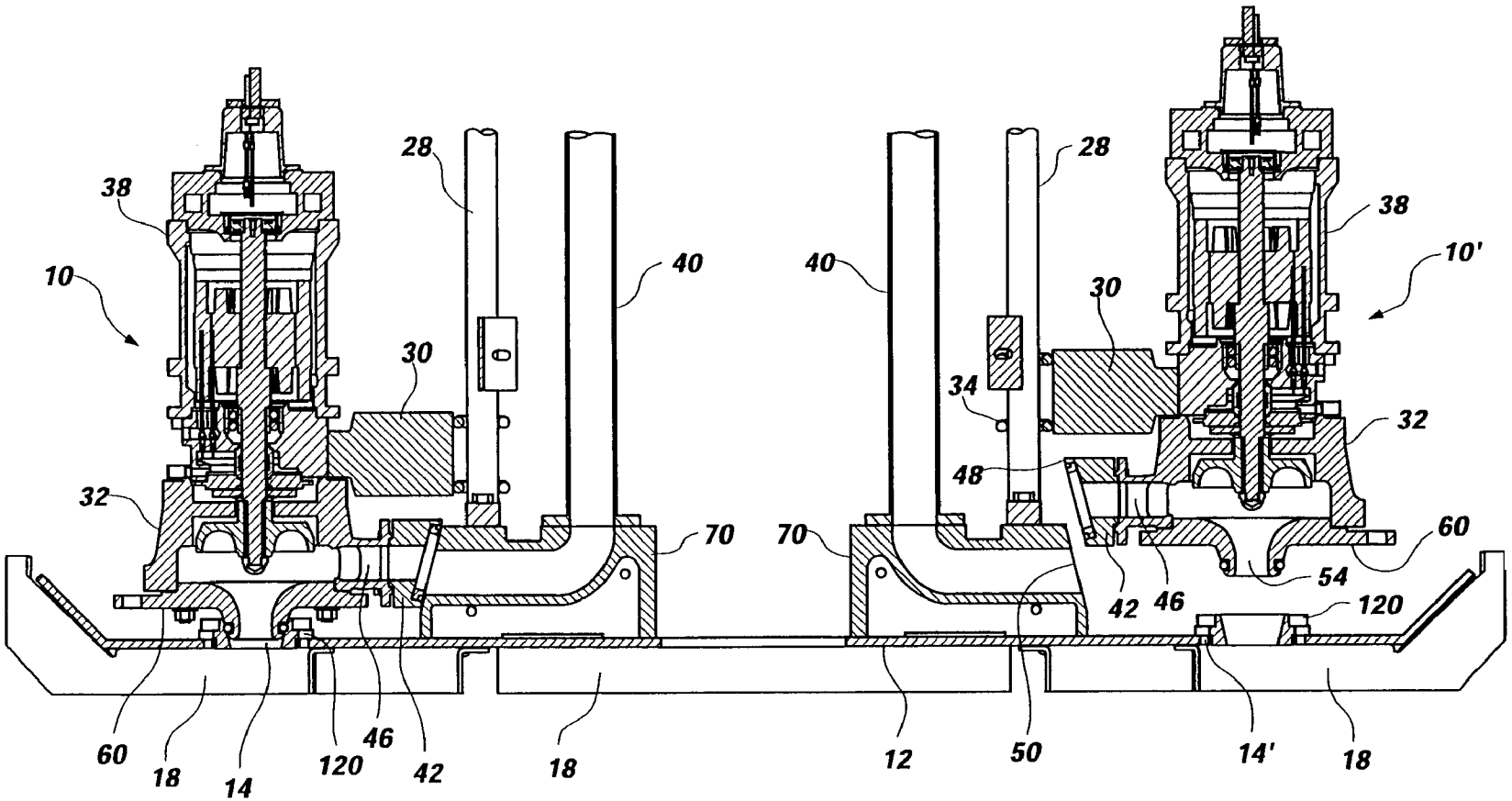
FIG. 4 is a view in cross section of the dual pump embodiment shown in FIG. 3.

Thus, as shown more clearly in the cross section view of FIG. 4, each pump 10, 10' includes a discharge adaptor 42 that is connected to the pump discharge outlet 46 of the pump 10, 10'. The discharge adaptor 42 has an angled face 48 that registers with an angled opening 50 in fluid communication with the discharge piping 40 of the well. It can generally be seen from FIG. 4 that the guide rails 28 and guide rail bracket 30 maintain the appropriate orientation and spacing of the pump 10, 10' with respect to the pump distribution plate 12 so that the discharge adaptor 42 comes into matingly sealed registration with the angled opening 50 of the discharge piping 40 and the pump inlet 54 is aligned for registration with the pump opening 14' in the pump distribution plate 12.

Figure 5:
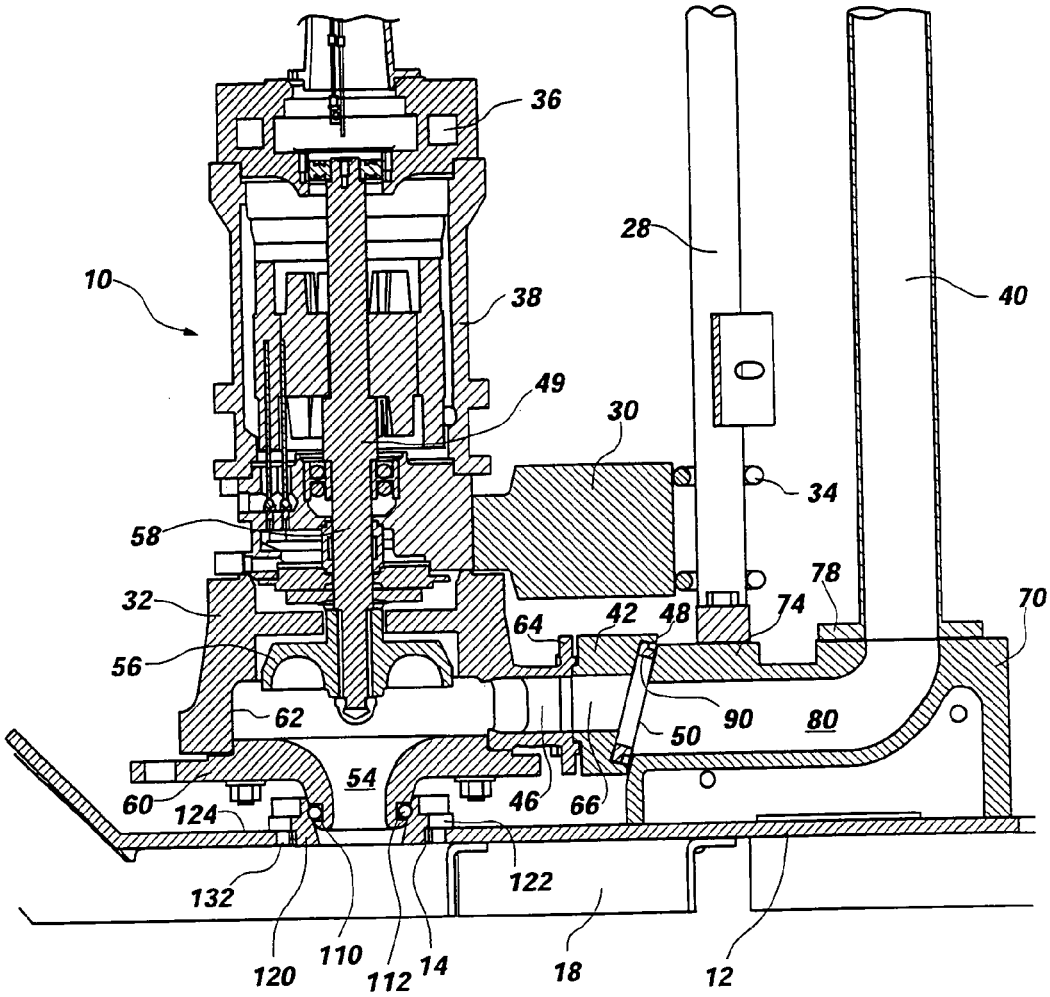
FIG. 5 is an enlarged view in cross section of one of the pumps illustrating detail of the pump inlet and discharge outlet.

FIG. 5 provides an enlarged view and further detail of the submersible pump 10 and the present invention. The pump casing 32 houses an impeller 56 that is connected to and driven by a drive shaft 58. A suction head plate 60 is secured to the pump casing 32 and provides a pump inlet 54 through which fluid is directed toward the impeller 56. The impeller 56 displaces the fluid to the volute 62 of the pump 10 and the fluid exists the pump 10 through the pump discharge outlet 46. The pump casing 32 at the pump discharge outlet 46 is formed with a flange 64 to which the discharge adaptor 42 is secured. The discharge adaptor 42 is formed with a bore 66 through which fluid moves from the pump discharge outlet 46 to the discharge piping 40.

Figure 6:
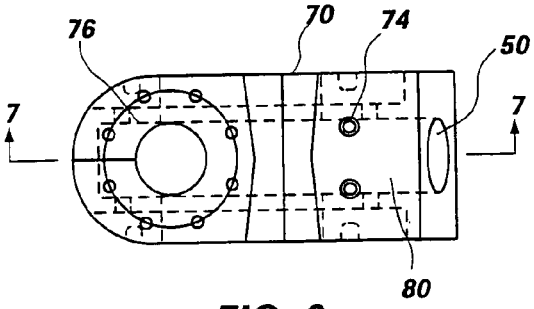
FIG. 6 is a plan view in partial phantom of a disconnect elbow stand of the present invention.
Figure 7:
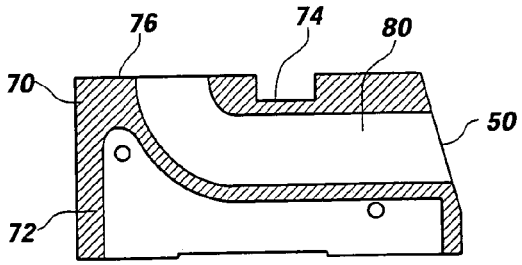
FIG. 7 is a view in cross section of the disconnect elbow stand shown in FIG. 6, taken at line 7-7.

In accordance with the present invention, a disconnect elbow stand 70 provides an intermediary conduit from the discharge adaptor 42 to the discharge piping 40. The disconnect elbow stand 70, shown in further detail in FIGS. 6 and 7, is structured with a pedestal portion 72 that provides means for attaching the disconnect elbow stand 70 to the pump distribution plate 12, as shown in FIG. 1. The disconnect elbow stand 70 is further structured with a connection point 74 for attachment of the guide rails 28 to the disconnect elbow stand, as also shown in FIG. 1, and is structured with an anchoring point 76 for securement of the flange 78 (FIG. 5) of the discharge piping 40 to disconnect elbow stand 70. The disconnect elbow stand 70 is further formed with a fluid conduit 80 that provides a fluid pathway from the angled opening 50 to the discharge piping 40.

Figure 9:
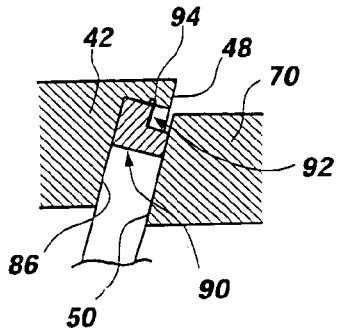
FIG. 9 is an enlarged partial view of the discharge adaptor and discharge seal ring.
Figure 8:
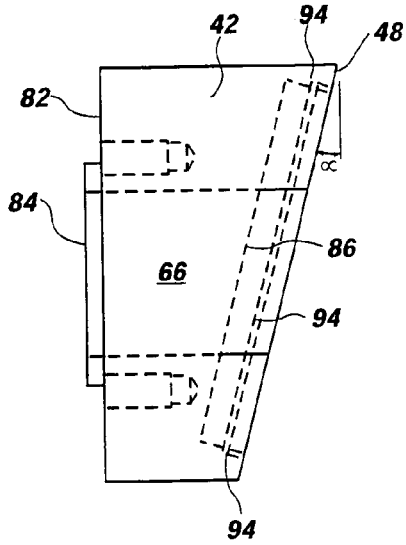
FIG. 8 is a view in elevation of the discharge adaptor of the present invention, some features being shown in phantom.

Referring again to FIG. 5, The discharge adaptor 42 has an angled face 48 which is complimentary to the angled opening 50 of the disconnect elbow stand 70. The detail of the discharge adaptor 42 shown in FIG. 8 illustrates that the discharge adaptor 42 is formed with an abutting surface 82 and centering ring 84 that is received in the flange 64 of the pump casing 32 surrounding the pump discharge outlet 46. The opposing surface of the discharge adaptor 42 is formed with an inwardly extending shoulder 86 that encircles the bore 66 of the discharge adaptor 42. The shoulder 86 provides for receipt of a discharge seal ring 90 therein, as shown in FIGS. 5 and 9.

The discharge seal ring 90 is preferably made of an elastomeric material having a durometer of between about Shore A 45 and Shore A 80. The discharge seal ring 90 is held in place within the shoulder 86 by a retaining ring 92 that is received in a groove 94 that encircles the shoulder 86. As best seen in FIG. 9, the discharge seal ring 90 is sized to extend proud of the angled face 48 of the discharge adaptor 42 so that it sealingly mates against the angled opening 50 of the disconnect elbow stand 70 when the pump 10 is lowered into the well.

The angle $\alpha$ (FIG. 8) of the angled face 48 of the discharge adaptor 42, relative to the vertical or central axis 49 of the pump, may be from about five degrees to about forty-five degrees or more. The angled face 48 and consequently the discharge seal ring 90 are thereby provided with sufficient vertical movement against the angled opening 50 of the disconnect elbow stand 70 to assure that a comprehensive seal will result when the pump 10 is vertically lowered into the well. Accordingly, a vertical drop in and lift out enables the pump 10 to be positioned with respect to the pump distribution plate 12 to increase solids entrainment while assuring that the pump 10 is sealed both at the pump discharge and at the pump inlet.

Figure 10:
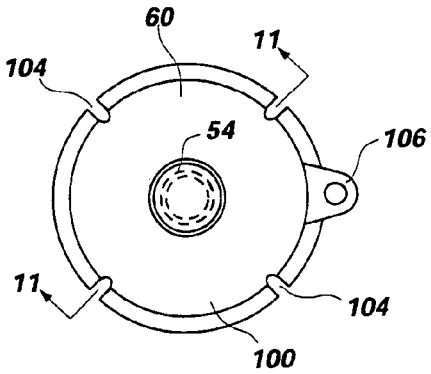
FIG. 10 is plan view of the suction head plate of the present invention.
Figure 11:
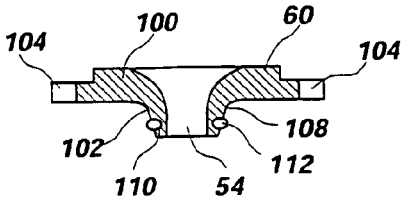
FIG. 11 is a view in cross section of the suction head plate shown in FIG. 10, taken at line 11-11.

Referring again to FIG. 5, the pump 10 is structured with a suction head plate 60 which attaches to the pump casing 32 at the suction end of the pump 10. Further detail of the suction head plate 60 is shown in FIGS. 10 and 11. The suction head plate 60 is structured with a generally flattened base portion 100 and a downwardly extending cylindrical portion 102 having a hollow bore that forms the pump inlet 54. As seen in FIG. 10, the suction head plate 60 is formed with slots 104 that aid in location of the suction head plate 60 on the pump casing 32. The suction head plate 60 may also be formed with an eye 106 that aids in lifting and assembling the suction head plate 60 to the pump casing 32.

Figure 12:
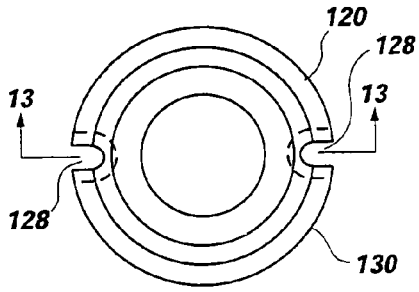
FIG. 12 is a plan view of the centering plate of the present invention.

The outer surface 108 of the cylindrical portion 102 of the suction head plate 60 may preferably be slightly angled inwardly and is formed with a groove 110 into which is received an inlet seal ring 112. The inlet seal ring 112 is preferably made from an elastomeric material having a durometer of between about Shore A 40 and Shore A 70. The outer surface 108 of the cylindrical portion 102 of the suction head plate 60 is configured to be received in a centering plate 120 that is positioned in the pump opening 14 of the pump distribution plate 12. Detail of the centering plate 120 is shown in FIGS. 12 and 13.

Figure 13:
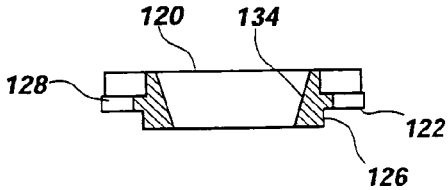
FIG. 13 is a view in cross section of the centering plate of FIG. 12, taken at line 13-13.

As best seen in FIGS. 5 and 13, the centering plate 120 has a flange portion 122 that rests on the upper surface 124 (FIG. 5) of the pump distribution plate 12 and has a downwardly extending ring portion 126 that extends into the pump opening 14 formed in the pump distribution plate 12. As shown in FIG. 12, slots 128 may be formed in the outer peripheral edge 130 of the centering plate 120 through which anchoring bolts, which extend through apertures 132 (FIG. 5) formed in the pump distribution plate 12, are positioned to locate and secure the centering plate 60 to the pump distribution plate 12.

The inner surface 134 of the centering plate 60, as best seen in FIG. 13, may preferably be angled inwardly (i.e., toward the center axis), thereby providing a conically-shaped opening for receipt of the suction head plate 60. Thus, the angled outer surface 108 of the cylindrical portion 102 of the suction head plate 60 is matingly received in the centering plate 60 as the pump 10 is lowered in to the well and is sealed by means of the sealing ring 112. The angle of the inner surface 134 of the centering plate 60 and corresponding angle of the outer surface 108 of the suction head plate 60 help locate and center the pump inlet 54 relative to the pump distribution plate 12 when lowering the pump 10 into place.

The pump distribution plate of the present invention provides improved means for entraining solids by submersible pumps, thereby improving solids pumping efficiencies. The quick disconnect system further provides the means by which a pump distribution plate of the present invention may be used while providing a comprehensive location and sealing of both the pump inlet and pump discharge in a vertical drop in situation. While the invention has been described and illustrated herein with respect to a dual pump configuration, it should be understood that a single pump arrangement may be provided while still employing the structural and functional elements of the invention; and more than two pumps may be used. Further, while the pump distribution plate has been described herein with respect to accommodating a removable submersible pump, it is equally as suitable to structure the pump distribution plate in a manner to permanently secure a submersible pump thereto such that the pump and pump distribution plate are dropped in and lifted out in tandem. Thus, it will be clear to those of skill in the art that the present invention may be adapted to a variety of uses and particular specifications of a given application. Hence, details of the invention described and illustrated herein are by way of example only and not be way of limitation.

What is claimed is:

1. A submersible pump system, comprising:

a submersible pump having a pump inlet and a pump discharge outlet structured for effecting remote connection of said submersible pump to a stationary discharge pipe opening and pump inlet-receiving opening located near the floor of a sump pit or tank;

a pump distribution plate positioned near the floor of a sump pit or tank, said pump distribution plate having a stationary discharge pipe secured to said plate and having at least one opening through said plate structured for remotely receiving said pump inlet upon lowering of said submersible pump into a sump pit or tank in which said pump distribution plate is positioned, and having a bottom surface for orientation toward the floor of a sump pit or tank, said pump distribution plate having guide members extending from said bottom surface toward the floor of a sump pit or tank for positioning said pump inlet above the floor of a sump pit or tank and said guide members being arranged in relation to said at least one opening to facilitate solids entrainment by direction of fluid and solids toward said at least one opening; and a centering member surrounding each said at least one opening in said pump distribution plate for receiving said pump inlet of said submersible pump in centered registration therewith.

2. The submersible pump system of claim 1 further comprising discharge piping having an angled opening and a disconnect system comprising an angled face surrounding said pump discharge outlet for assuring mating and sealing of said pump discharge outlet to said angled opening of said discharge piping.

3. The submersible pump system of claim 2 further comprising a discharge elbow stand configured with said angled opening, and secured to said pump distribution plate and said discharge piping.

4. The submersible pump system of claim 1 wherein said pump inlet is configured with an inlet sealing ring to provide sealing engagement of said pump inlet with said centering member.

5. The submersible pump system of claim 1 further comprising a guide rail system connection to said pump distribution plate.

6. The submersible pump system of claim 5 wherein said guide rail system further comprises a guide rail bracket connected to said submersible pump.

7. The submersible pump system of claim 3 further comprising a guide rail system connected to said discharge elbow stand and positioned to guide movement of said submersible pump into and out of a well or tank.

8. The submersible pump system of claim 1 wherein said submersible pump has a pump casing having a suction side, and further comprising a suction head plate positioned between said suction side of said pump and said at least one opening of said pump distribution plate, said pump inlet being formed in said suction head plate.

9. The submersible pump system of claim 8 further comprising an inlet seal ring positioned on said pump inlet of said suction head plate to sealingly engage said pump inlet to said centering member.

10. The submersible pump system of claim 9 wherein said centering member has an angled inner surface and said pump inlet of said suction head plate has an outer angled surface for guiding said pump inlet into said centering member along said angled inner surface of said centering member.

11. The submersible pump system of claim 9 further comprising discharge piping having an angled opening and a disconnect system comprising an angled face surrounding said pump discharge outlet for assuring mating and sealing of said pump discharge outlet to said angled opening of said discharge piping.

12. The submersible pump system of claim 11 wherein said angled face of said pump discharge outlet is configured to retain a discharge seal ring positioned thereabout for sealing against said angled opening of said discharge piping.

* * * * *